US008955719B2

(12) United States Patent
Li et al.

(10) Patent No.: US 8,955,719 B2
(45) Date of Patent: Feb. 17, 2015

(54) FOAMING LIQUID DISPENSER

(75) Inventors: MingDong Li, Hong Kong (HK); ZhiHao Liang, Dongguan (CN); XianZhi Zhou, Dongguan (CN)

(73) Assignee: Reckitt Benckiser LLC, Parsippany, NJ (US)

( * ) Notice: Subject to any disclaimer, the term of this patent is extended or adjusted under 35 U.S.C. 154(b) by 0 days.

(21) Appl. No.: 13/879,741

(22) PCT Filed: Oct. 21, 2011

(86) PCT No.: PCT/GB2011/052046

§ 371 (c)(1), (2), (4) Date: Apr. 16, 2013

(87) PCT Pub. No.: WO2012/056220

PCT Pub. Date: May 3, 2012

(65) Prior Publication Data

US 2013/0200098 A1 Aug. 8, 2013

(30) Foreign Application Priority Data

Oct. 26, 2010 (GB) ..... 1018005.7

(51) Int. Cl.

| | |
|---|---|
| ***B05B 7/26*** | (2006.01) |
| ***A47K 5/16*** | (2006.01) |
| ***B05B 7/00*** | (2006.01) |
| ***B05B 7/24*** | (2006.01) |
| ***B05B 12/02*** | (2006.01) |
| ***B67D 7/08*** | (2010.01) |

(52) U.S. Cl.

CPC . *B05B 7/262* (2013.01); *A47K 5/16* (2013.01); *B05B 7/0025* (2013.01); *B05B 7/0037* (2013.01); *B05B 7/2464* (2013.01); *B05B 12/02* (2013.01); *B67D 7/08* (2013.01)

USPC ..... 222/190; 222/52

(58) Field of Classification Search

CPC ..... B67D 7/08; A47K 5/16

USPC ..... 222/190, 135, 52, 63, 333, 185.1

See application file for complete search history.

(56) References Cited

U.S. PATENT DOCUMENTS

| | | | | |
|---|---|---|---|---|
| 5,556,005 | A * | 9/1996 | Banks | 222/96 |
| 6,279,777 | B1 * | 8/2001 | Goodin et al. | 222/52 |
| 6,386,403 | B2 * | 5/2002 | Parsons et al. | 222/399 |
| 6,626,332 | B2 * | 9/2003 | Ehrensperger et al. | 222/190 |

(Continued)

FOREIGN PATENT DOCUMENTS

| | | |
|---|---|---|
| EP | 1781417 A1 | 5/2007 |
| EP | 2082809 A1 | 7/2009 |

(Continued)

OTHER PUBLICATIONS

International Search Report mailed Mar. 2, 2012 for priority application PCT/GB2011/052046.

(Continued)

*Primary Examiner* — Donnell Long

(74) *Attorney, Agent, or Firm* — Troutman Sanders LLP; Ryan A. Schneider; Chris Davis

(57) ABSTRACT

Disclosed is a foaming pump mechanism for dispensing a foamable or foaming liquid composition, as well as dispensers for delivery of a foaming or foamable liquid composition therefrom, which is operable by a non-contact interaction with the user.

16 Claims, 6 Drawing Sheets

(56) References Cited

U.S. PATENT DOCUMENTS

| | | | | |
|---|---|---|---|---|
| 7,543,722 | B2 * | 6/2009 | Yates et al. | 222/135 |
| 8,109,411 | B2 * | 2/2012 | Yang et al. | 222/52 |
| 8,267,284 | B2 * | 9/2012 | Ray | 222/190 |
| 8,522,670 | B2 * | 9/2013 | Tonelli et al. | 99/300 |
| 8,550,378 | B2 * | 10/2013 | Mazooji et al. | 239/333 |
| 8,596,502 | B2 * | 12/2013 | Kwasny | 222/402.21 |
| 8,662,356 | B2 * | 3/2014 | Padain et al. | 222/325 |
| 2007/0051748 | A1 | 3/2007 | Yates | |
| 2007/0251953 | A1 | 11/2007 | Criswell | |
| 2009/0151573 | A1 * | 6/2009 | Tonelli et al. | 99/280 |

FOREIGN PATENT DOCUMENTS

| | | | |
|---|---|---|---|
| WO | 0130508 | A1 | 5/2001 |
| WO | 2010055309 | A1 | 5/2010 |
| WO | 2010055313 | A1 | 5/2010 |
| WO | 2010055314 | A1 | 5/2010 |

OTHER PUBLICATIONS

International Search Report and Written Opinion dated Jan. 31, 2011 for priority application GB 1018005.7.

International Preliminary Report on Patentability; PCT/GB2011/052046; Report prepared Apr. 30, 2013 by Athina Nickitas-Etienne.

* cited by examiner

FOAMING LIQUID DISPENSER

CROSS-REFERENCE TO RELATED APPLICATIONS

This application is a US National Stage of International Application No. PCT/GB2011/052046, filed 21 Oct. 2011, which claims the benefit of GB 1018005.7, filed 26 Oct. 2010, both herein fully incorporated by reference.

FIELD OF THE INVENTION

The present invention relates to a dispenser for a foaming liquid composition. More particularly the present invention relates to a dispenser for delivery of a foaming liquid composition from a refill unit containing a quantity of the foaming liquid composition which is fitted into said dispenser, although the principles of the present invention may be used in dispensers which contain a foaming liquid composition in a receptacle or reservoir other than a refill unit.

BACKGROUND OF THE INVENTION

From a consumer perspective, dispensers which automatically provide a metered dose of a foaming liquid composition are highly desirable. Delivery of a foamed liquid composition, e.g., a soap, a cleaning composition, a topical treatment composition, a foamed or foamable composition for application to the epidermis, hair or other part of a human or animal body is advantageous in several respects. The foam structure of the foamed liquid composition provides for a mass of the liquid composition with an expanded volume due to the air or other gas entrained within the foamed liquid composition which provides a perception of a greater mass of product being delivered, and at the same time the foamed liquid composition is frequently easier to deliver to a surface e.g., a hard surface, an epidermis, etc. Furthermore the use of a foamed liquid composition often accelerates the spreading and distribution of the foamed liquid composition onto a surface.

Currently dispensers which provide a metered dose of a foaming liquid composition are often manually operated pump-type dispensers which requires that a user must necessarily compress a part of the pump, in order to deliver a dose of foamed liquid composition. Such requires physical contact between the user and the dispenser, which is not always desirable. Many common maladies, e.g., influenza virus, rhinovirus, may be undesirably transmitted between users of such a manually operated pump-type dispenser which increases the incidence and spread of diseases. Furthermore, manually operated pump-type dispensers also frequently become unattractive in appearance due to repeated physical contact between the user and the dispenser which user while utilizing the dispensed foamed liquid composition provided, rarely or consistently also cleans the pump.

Known to the art are automatic dispensers for the delivery of liquids from a reservoir contained within the said dispenser device, which may be a reservoir for storing liquids prior to their delivery, particularly for dispensing liquid soaps in response to a non-contact interaction with the user, e.g. the use of one or more sensors to determine the proximity of a user. Such "hands free" dispensing devices and refill units useful therewith are generally known to the art, and include those commonly assigned to the proprietor of the instant patent application. Such include the dispenser and refill unit disclosed in PCT/GB2009/002682; a relief valve and a cap assembly as disclosed in PCT/GB2009/002672, as well as the bottle with a tamper proof-cap as disclosed in PCT/GB2009/002678. The entire contents of these patent applications are herein incorporated by reference thereto. While the dispenser and refill unit described in WO 2010/055314 provides certain advantages over other prior art dispensers and while it may be very advantageously used for the delivery of a liquid composition, it is poorly suited for reliably dispensing foaming liquid compositions in the manner provided by the present application, particularly metered doses of a foamed liquid composition.

Thus there is a real and urgent need for further improvements to dispensers for the delivery of a foaming or foamable liquid composition therefrom.

BRIEF SUMMARY OF THE INVENTION

In one aspect the present invention provides a foaming pump mechanism for dispensing a foamable or foaming liquid composition.

In a second aspect of the invention there is provided a dispenser for a foaming or foamable liquid composition therefrom which is operable by a non-contact interaction with the user.

In a third aspect the present invention provides a dispenser for a foaming or foamable liquid composition therefrom which delivers the said composition from a user replaceable refill.

In a fourth aspect the present invention provides a dispenser for a foaming or foamable liquid composition therefrom which delivers the said composition from a vessel, container or reservoir which forms a part of the said dispenser.

In a yet further aspect the present invention provides a method for dispensing a foaming or foamable liquid composition to a user which dispensing is initiated by a non-contact interaction with the user.

BRIEF DESCRIPTION OF THE FIGURES

Further features and aspects of the invention will be understood from a reading of the following specification, and in view of the accompanying drawing figures. In the drawing figures, like elements present are indicated using the same reference numeral for consistency throughout the drawing figures.

DETAILED DESCRIPTION OF PREFERRED EMBODIMENTS

The dispensing device may be one which is manually powered, e.g., a pump-type dispenser whereby a quantity of foamable liquid composition is dispensed by manually operating the foaming pump mechanism. In a preferred aspect the present invention provides a dispenser which comprises a base with a delivery mechanism for dispensing a foamable liquid composition (liquid product) therefrom which base also includes an actuator means. The actuator means is preferably a mechanism which does not require physical contact between a user of the dispenser in order to initiate delivery of a quantity of a foamed liquid composition to the user. The actuator means actuation mechanism advantageously includes one or more sensors which are responsive to the proximity of a user to the dispenser device which triggers the actuator means to deliver the quantity of a the foamable liquid composition through the foaming pump mechanism to the user. The dispensing device may also be a device which includes a motor driven pump, such as disclosed in PCT/GB2009/002682 the contents of which are herein incorporated by reference thereto, but in which the foaming pump mechanism is installed or included.

Figure 1:
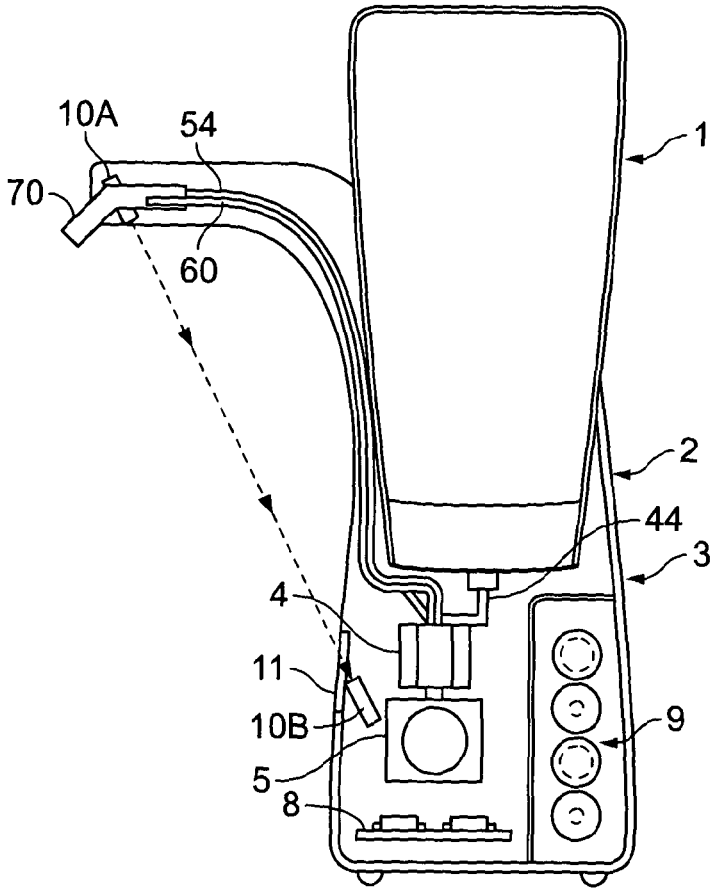
FIG. 1 illustrates a cross-sectional view of a hands-free dispensing device, and a refill unit mounted therein wherein the device includes a foaming pump mechanism as will be described in more clearly with reference to the following figures.

FIG. 1 illustrates a hands-free dispenser which is generally suitable for domestic use which includes the combination of a refill unit 1 with a base 2. The refill unit 1 provides a supply or a supply reservoir of a foamable liquid product (liquid composition) to be dispensed via the base 2. The refill unit 1 is removably insertable into the base 2 such that when exhausted, a fresh supply may be provided to the said dispenser. The base 2 has an interface 3 which is in fluid communication with a foaming pump mechanism 4 driven by a motor 5, which is in turn in fluid communication with a dispensing nozzle 70 via an intermediate liquid outlet tube 60 and an intermediate air outlet tube 54. The foaming pump mechanism 4 is selectively operable to pump a metered dose of the foamable liquid composition in response to a suitable control or trigger signal. The base 2 further includes suitable controller logic circuitry 8 herein depicted as a printed circuit board having one or more solid-state components included thereon which operates as a controller means for the base 2, a power source, here depicted as an array of batteries 9, here four "AA" nominal 1.5 DC voltage batteries, and an infrared transmitter 10A which transmits an infrared beam through a window 11 to an infrared receiver 10B noted to sense the presence of a user's hands in the vicinity of the base 2. The controller logic circuitry 8 is responsive to the signal from the infrared beam transmitter 10A and infrared receiver 10B to activate the foaming pump mechanism 4. In the depicted embodiment, the illustrated infrared beam transmitter 10A and infrared receiver 10B are of the "break beam" type, however any known proximity sensor can be used. One such proximity sensor is a capacitance sensor, but others known to the art can be used in place of the beam transmitter 10A and infrared receiver 10B. Alternately a mechanical switch or other actuation means which requires physical contact with a user in order to activate the foaming pump mechanism 4 in order to dispense a quantity of liquid may be used in place of the proximity sensor wherein a hands-free mode of operation is unnecessary or not desired.

In FIG. 1, although an array of batteries 9 is illustrated, the base 2 can be powered by any suitable power source, including but not limited to direct connection to a power supply, to wall mains power, or via an intermediate voltage step down transformer or other power supply intermediate the base 2 and the wall mains power. The base 2 may also be supplied with rechargeable batteries. The operation of rechargeable batteries may be supplemented by, or the batteries may be charged by, a photovoltaic panel responsive to light and which generates a current.

Figure 2A:
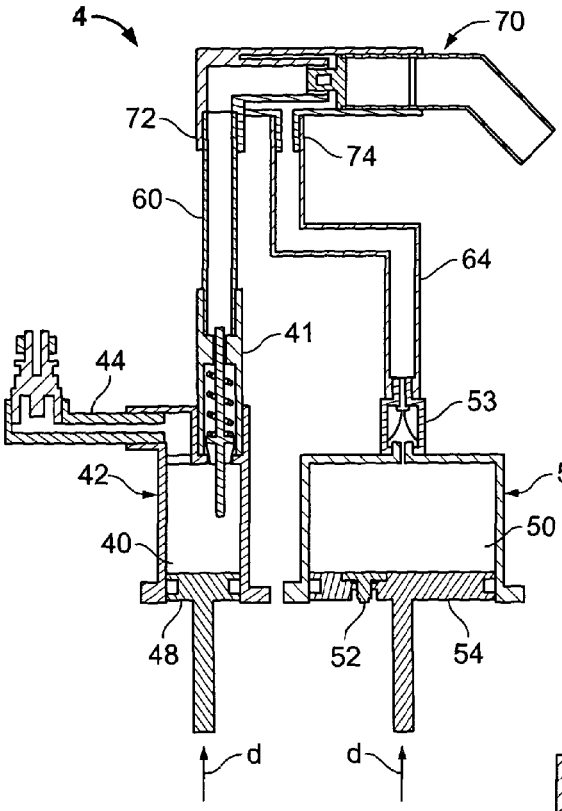
FIGS. 2A, 2B, 2C and 2D illustrate in cross-sectional views a preferred embodiment of a foaming pump mechanism in four different and sequential states of operation.
Figure 2B:
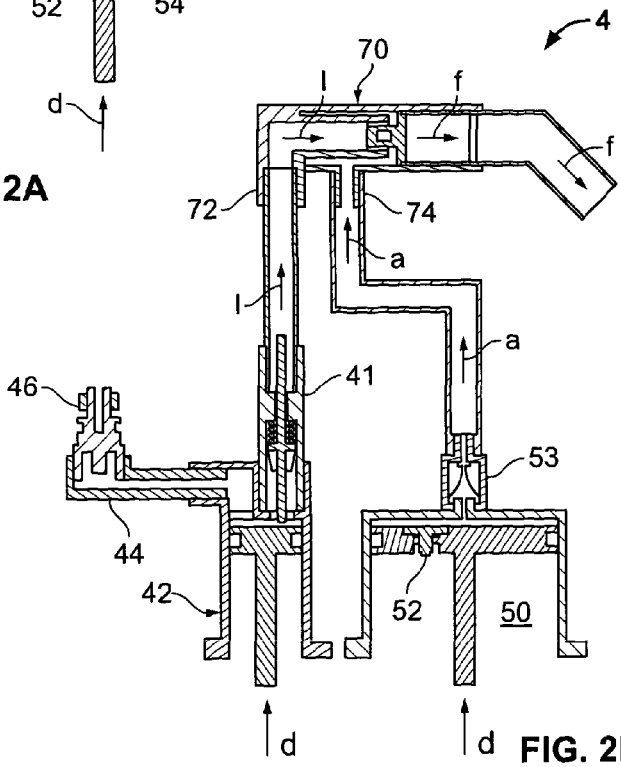

FIG. 2A illustrates in a representational cross-sectional view a first state of the foaming pump mechanism 4 according to a preferred embodiment of the invention. As depicted thereon, the bore 40 of the liquid cylinder 42 is in fluid communication via a supply tube 44 and a supply valve 46 with a supply of a foaming or foamable liquid composition (not shown) which said supply may be, a reservoir or a refill bottle containing a quantity of the foamable liquid composition. In this first state, the bore 40 is filled with the foamable liquid composition, and the liquid cylinder piston 48 is at the base (bottom) of its stroke cycle, coinciding with the largest volume of the bore 40. Concurrently the bore 50 of the air cylinder 52 is filled with air which has entered the bore 50 via an air supply valve 52 present within the air cylinder piston 54, which is also at the base of its stroke cycle, coinciding with the largest volume of bore 50. Also visible in the figure and downstream of the bore 40 of the liquid cylinder 42 is a liquid outlet valve 41. As more clearly shown on FIGS. 3A and 3B, the liquid outlet valve 41 comprises a valve bore 41A, a biasing spring 41B, a bore shoulder 41C, a valve seat 41D and a valve 41E mounted upon a valve shaft 43 which at least partially extends into the bore 40, said valve shaft 43 being longer "vs" than the height "h" of the valve bore 41A as measured between the bore shoulder 41C and the valve seat 41D, and preferably as shown, the valve shaft 43 has a proximal end 43A extending at least to but preferably past the valve seat 41D and into the bore 40, and a distal end 43B extending at least to, but preferably past the bore shoulder 41C. The biasing spring 41B extends within the valve bore 41A about a part of the valve shaft 43 and extends between the bore shoulder 41C and the valve 41E biasing the valve 41E into the valve seat 41D when the proximal end 43A is not in contact with the liquid cylinder piston 48. In the position or state shown in FIG. 3A, the valve 41E is engaged against the valve seat 41D which closes the liquid outlet valve 41 denying passage of the foamable liquid composition therethrough. The liquid outlet valve 41 is connected to a liquid outlet tube 60 which itself extends to and is in fluid communication with a dispensing nozzle 70 via a liquid inlet port 72. Referring to FIGS. 2A and 2B, downstream of the bore 50 of the air cylinder 52 is an air outlet 53 valve, an air outlet tube 64 which itself extends and is in fluid communication with the dispensing nozzle 70 via an air inlet port 74. In the first state of the foaming pump mechanism, the maximum volume of the bore 40 and of bore 50 is established by the relative positions of the piston. Further, the supply valve 46 is in an open state or open position, while the liquid outlet valve 41, the air outlet valve 53 and the air supply valve 52 are in a closed state or in a closed position.

In FIGS. 2A-2D, the direction of travel of liquid within the foaming pump mechanism 4 is illustrated by directional arrows labeled "l", the directional travel of air foaming pump mechanism 4 is illustrated by directional arrows labeled "a", the direction of motion of the pistons 48, 54 is illustrated by directional arrows labeled "d", the direction of travel of foamed liquid composition within the foaming pump mechanism 4 is illustrated by directional arrows labeled "f", the direction of travel of foam and/or liquid composition is illustrated by directional arrows labeled "f/l", and the direction of travel of foamable liquid composition from its supply source (e.g., reservoir, refill bottle, refill unit) is illustrated by directional arrows labeled "s". As is visible from the state of the foaming pump mechanism 4 illustrated in FIG. 2A, the liquid, air and foam are essentially static at the base of the stroke cycle of cylinders 48, 54.

FIG. 2B illustrates in a cross-sectional view a second and successive state of the foaming pump mechanism according to a preferred embodiment of the invention. As seen from the figure, the liquid cylinder piston 48 is at the peak of its stroke cycle, coinciding with the minimal volume of the bore 40, and the air cylinder piston 54 is also at the peak (top) of its stroke cycle, coinciding with the minimal volume of bore 50. As the respective pistons 48, 54 move from the positions of the first state to the second state as here depicted, the foamable liquid composition present in the bore 40 is pressurized which causes the supply valve 46 to close, and concurrently causes the liquid outlet valve 41 to an open position due to the movement of the valve shaft 43 due to the contact between the proximal end 43A of the valve shaft 43 with the liquid cylinder piston 48 which forces the valve shaft 43 to disengage (lift) the valve 41E from the valve seat 41D which compresses the biasing spring 41B and also opens the liquid outlet valve 41 permitting the passage of the foamable liquid composition present in the bore 40 therethrough. The foamable liquid composition is forced through the liquid outlet valve 41 and through the liquid outlet tube 60 and via the liquid inlet port 72 into the dispensing nozzle 70, as indicated by directional arrows "l". Concurrently the air present within the bore 50 of the air cylinder 52 is forced past the air outlet valve 53 which is forced into an open state or open position, and via the air outlet tube 64 into the dispensing nozzle 70 via an air inlet port 74 which port is downstream of the liquid inlet port 72 of the dispensing nozzle 70. The direction of air flow is indicated by directional arrows "a". The foamable liquid and air thus injected via their respective inlet ports 72, 74 are mixed within the dispensing nozzle 70 and expelled therefrom, viz., is delivered as a foaming or foamable liquid composition from a delivery outlet 73 (see FIG. 4) of the dispensing nozzle 70 as indicated by directional arrows "f". Further details of the dispensing nozzle 70 are disclosed in further figures.

Figure 2C:
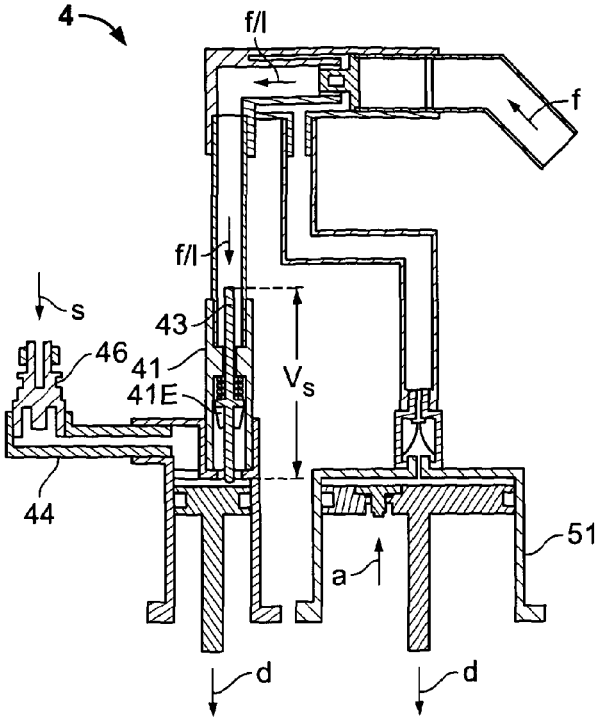

FIG. 2C illustrates in a cross-sectional view a third and successive state of the foaming pump mechanism according to a preferred embodiment of the invention which follows immediately after the second state of the foaming pump mechanism. In this third state, the liquid cylinder piston 48 and the air cylinder piston 54 have transited just past the peak (top) of their stroke cycles and are returning to the base (bottom) of their stroke cycles. At this third state, the downward movement of the liquid cylinder piston 48 and the air cylinder piston 54 generates a suction within the dispensing nozzle 70 and the liquid outlet tube 60 and via the liquid inlet port 72 due to the operation of the liquid outlet valve 41. Concurrently, however, no like suction is present within the air outlet tube 64 as the downward movement of the air cylinder piston 54 causes the air outlet valve 53 to close sealing it from the bore 50 which is resupplied with air via the air supply valve 52 present within the air cylinder piston 54 which is urged into an open position and permits for the passage of ambient air to enter into the bore 50. As the liquid cylinder piston 48 continues its downward transit towards the base of its stroke, the transiting air cylinder piston 54 continually generates a suction within the bore 40 which causes at least partial retraction of the foamable liquid composition and/or foamed liquid composition present within the dispensing nozzle 70, the liquid outlet tube 60 or both, while the contact between the proximal end 43A of the valve shaft 43 with the liquid cylinder piston 48 persists and causes the valve 41E positioned on the valve shaft 43 to remain disengaged (lifted) from the valve seat 41D, thereby permitting reentry of the foamable liquid composition and/or foamed liquid composition into the bore 40 of the liquid cylinder 42.

Figure 2D:
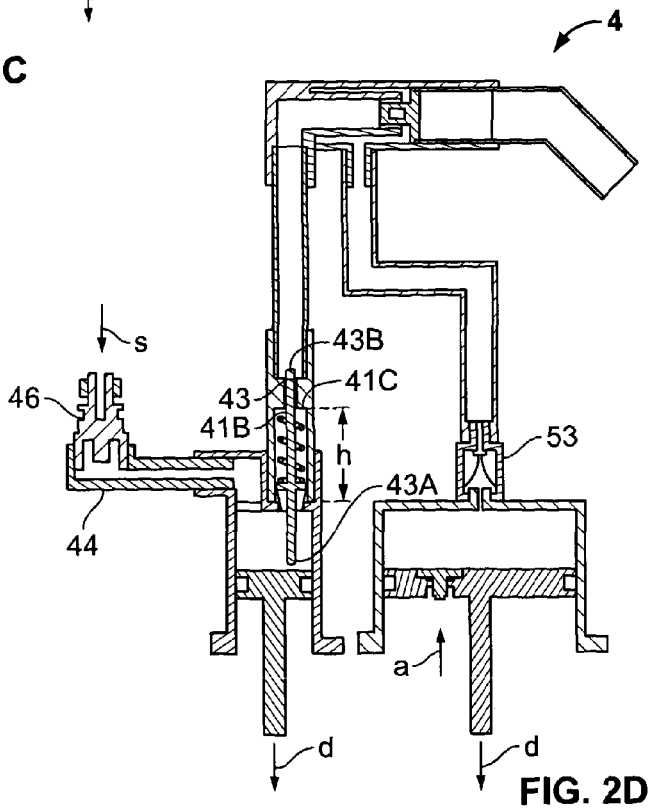

FIG. 2D illustrates in a cross-sectional view a fourth and successive state of the foaming pump mechanism according to a preferred embodiment of the invention which follows immediately after the third state of the foaming pump mechanism. In this fourth state, the liquid cylinder piston 48 and the air cylinder piston 54 have transited approximately midway from the peak (top) of their stroke cycles and are returning to the base (bottom) of their stroke cycles. At this fourth state, the downward movement of the air cylinder piston 54 causes the air outlet valve 53 to close, sealing it from the bore 50 which is resupplied with air via the air supply valve 52 present within the air cylinder piston 54 which is urged into an open position and permits for the passage of ambient air to enter into the bore 50, and thus resupplying it. At this point of its transit, the cylinder piston 48 continues its downward transit towards the base of its stroke, the contact between the proximal end 43A of the valve shaft 43 with the liquid cylinder piston 48 ceases which causes the valve 41E positioned on the valve shaft 43 to engage the valve seat 41D due to the action of the a biasing spring 41B, thereby closing the liquid outlet valve 41 denying passage of the foamable liquid composition therethrough and breaking any suction caused by the liquid cylinder piston 48 and liquid cylinder 42 within the dispensing nozzle 70, the liquid outlet tube 60 or both. Concurrently at this point of its transit, the suction within the liquid cylinder 42 caused by the continued transit of the liquid cylinder piston 48 returning to the base it its stroke cycle increases the flow rate of foamable liquid composition entering into the bore 40 via the supply tube 44 and past the supply valve 46 which is in fluid communication with the supply of the foamable liquid composition. The downward strokes of the liquid cylinder piston 48 within the liquid cylinder 42 and of the air cylinder piston 54 within the air cylinder 52 cause the respective cylinders 42, 52 to be refilled with foamable liquid composition and air until the respective pistons 40, 50 return to the base (bottom) of their stroke cycles, and return to the first state of the foaming pump mechanism described with reference to FIG. 2A.

Amongst further important features of the foaming pump mechanism is the volumetric delivery rate of the foaming or foamable liquid composition and the air during a stroke cycle of the foaming pump mechanism. Conveniently such may be established by or at least approximated by the differences in the volumes of the liquid cylinder 42 and the air cylinder 52 between the base and peak of the stroke cycles of their respective liquid cylinder piston 48 and air cylinder piston 58. Alternately the volumetric delivery rate of the foaming or foamable liquid composition and the air during a stroke cycle of the foaming pump mechanism can be established by actual quantitative measurement of the foaming or foamable liquid composition and the air during a stroke cycle delivered between the base and peak of a stroke cycle of the respective liquid cylinder piston 48 and air cylinder piston 58. Advantageously the volumetric ratios of the volumes of the liquid cylinder 42 and the air cylinder 52 between the base and peak of the stroke cycles is between 1:0.1-25, preferably is between 1:1-20, and especially preferably is between about 1:5-15, and most preferably is about 1:10 (liquid cylinder:air cylinder). Advantageously the volume of the liquid cylinder between the base and peak of the stroke cycle is approximately between about 0.5-2.5 cubic centimeters, preferably is between about 0.5-1.5 cubic centimeters. Concurrently advantageously the relative volume of the air cylinder between the base and the peak of the stroke cycle is approximately 3 times to 12 times, preferably approximately 5 times to 12 times that of the volume of the liquid cylinder between the base and peak of its stroke cycle. Alternately the ratios of the volumetric delivery rate of the foaming or foamable liquid composition and the air during a stroke cycle of the foaming pump mechanism is between about 1:1-20, preferably is between about 1:5-15. It is to be understood that the foregoing ratios are provided by way of illustration and not by way of limitation, as a skilled artisan will readily comprehend that the constituents used to form a foaming or foamable liquid composition may vary widely, and the degree of foaming of the said liquid composition may also vary widely as it is delivered from the foaming pump mechanisms described herein. Thus a wide degree of latitude in the specification of the said volumetric ratios, or the said ratios of the volumetric delivery rate are permitted as being in no small part due to the composition of the foaming or foamable liquid composition to be dispensed and delivered as a foamed product from the foaming pump mechanisms described herein.

It is to be understood, that although not specifically shown in of the drawing figures, the pistons are preferably driven by a crankshaft, shaft with cams or other drive mechanism which provides for reciprocating movement of the liquid cylinder piston 48 and the air cylinder piston 58. Such drive mechanism may be driven by any appropriate means, e.g., either directly by a motor, such as an electrical motor, or indirectly such as via a motor coupled to one or more gears such as in a gearbox, which in turn is coupled to a crankshaft, shaft with cams or other drive mechanism which provides for reciprocating movement. The motor may be a stepper motor as well which provides for controlled rotational movement of the crankshaft, shaft with cams or other drive mechanism which provides for reciprocating movement. Desirably the pistons are moved in concentric manner.

Figure 3A:
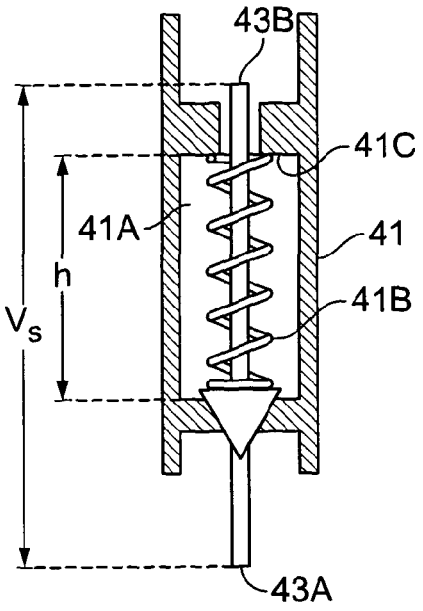
FIGS. 3A and 3B illustrate in cross-sectional views the liquid outlet valve in two different states of operation.
Figure 3B:
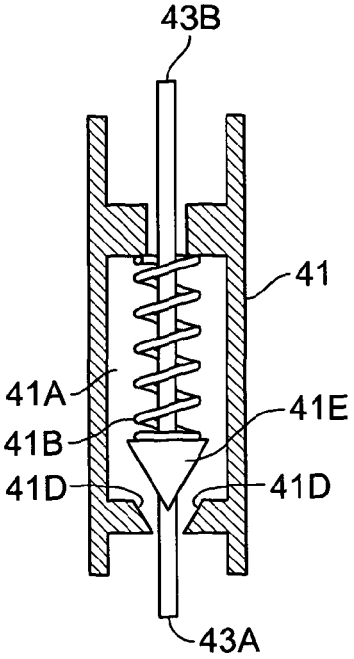

FIGS. 3A and 3B illustrate in cross-sectional views the liquid outlet valve in two different states of operation. The liquid outlet valve 41 comprises a valve bore 41A, a biasing spring 41B, a bore shoulder 41C, a circular valve seat 41D and a circular valve 41E mounted transversely upon a valve shaft 43. The circular valve seat 41D and the valve 41E are abuttable to form a liquid tight seal therebetween when the circular valve 41E is seated upon or within the circular valve seat 41D. Of course different configurations of valves and valve seats other than disclosed herein in FIGS. 3A and 3B may be used, as long as such fulfill a similar function as the depicted elements. The valve shaft 43 is being longer having a dimension "vs" which is greater than the height having a dimension "h" of the valve bore 41A as measured between the bore shoulder 41C and the valve seat 41D, and preferably as shown, the valve shaft 43 has a proximal end 43A extending at least to but preferably past the valve seat 41D and into the bore 40, and a distal end 43B extending at least to, but preferably past the bore shoulder 41C. The biasing spring 41B extends within the valve bore 41A about a part of the valve shaft 43 and extends between the bore shoulder 41C and the valve 41E biasing the valve 41E into the valve seat 41D when the proximal end 43A is not in contact with the liquid cylinder piston 48. In the position or state shown in FIG. 3A which corresponds to the state of the liquid outlet valve depicted in FIG. 2A, the valve 41E is engaged against the valve seat 41D which closes the liquid outlet valve 41 denying passage of the foamable liquid composition therethrough. In the position or state shown in FIG. 3A which corresponds to the state of the liquid outlet valve depicted in FIG. 2B, the valve 41E is disengaged from the valve seat 41D which opens closes the liquid outlet valve 41 permitting passage of the foamable liquid composition therethrough.

Figure 3C:
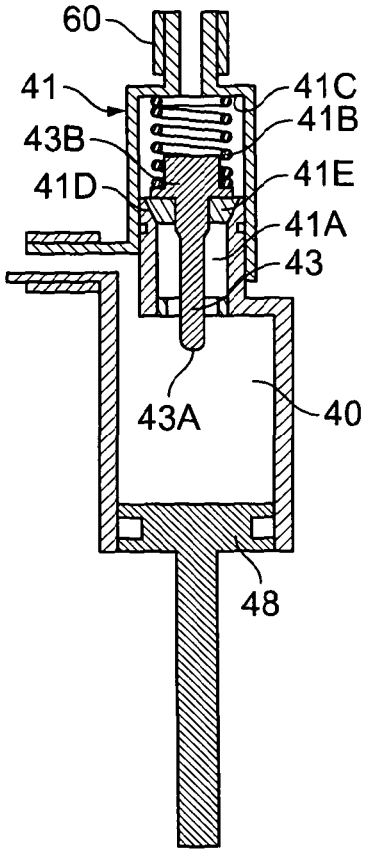
FIGS. 3C and 3D illustrate in cross-sectional views of an alternate embodiment of the liquid outlet valve in two different states of operation.
Figure 3D:
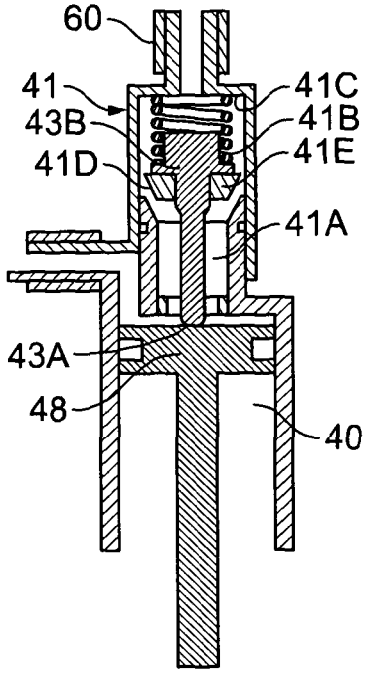

FIGS. 3C and 3D illustrate in cross-sectional views of an alternate embodiment of the liquid outlet valve in two different states of operation, which operates in a manner similar to the liquid outlet valve 41 of FIGS. 3A and 3B. Herein the liquid outlet valve 41 comprises a valve bore 41A, a biasing spring 41B, a bore shoulder 41C, a valve seat 41D and a frustoconical valve 41E mounted transversely upon a valve shaft 43. The valve seat 41D and the frustoconical valve 41E are abuttable to form a liquid tight seal therebetween when the circular valve 41E is seated upon or within the circular valve seat 41D, as illustrated in FIG. 3C. The valve shaft 43 has a proximal end 43A extending at least to but preferably past the valve seat 41D and into the bore 40, and a distal end 43B extending in abutment with the biasing spring 41B. The biasing spring 41B extends within the valve bore 41A about a part of the distal end 43B and extends between it and the bore shoulder 41C biasing the frustoconical valve 41E into the valve seat 41D when the proximal end 43A is not in contact with the liquid cylinder piston 48. In the position or state shown in FIG. 3C which corresponds to the state of the liquid outlet valve depicted in FIG. 2A, the frustoconical valve 41E is engaged against the valve seat 41D which closes the liquid outlet valve 41 denying passage of the foamable liquid composition therethrough. In the position or state shown in FIG. 3D which corresponds to the state of the liquid outlet valve depicted in FIG. 2B, the valve 41E is disengaged from the valve seat 41D which opens the liquid outlet valve 41 permitting passage of the foamable liquid composition therethrough from the bore 40 and the liquid outlet tube 60.

Figure 4:
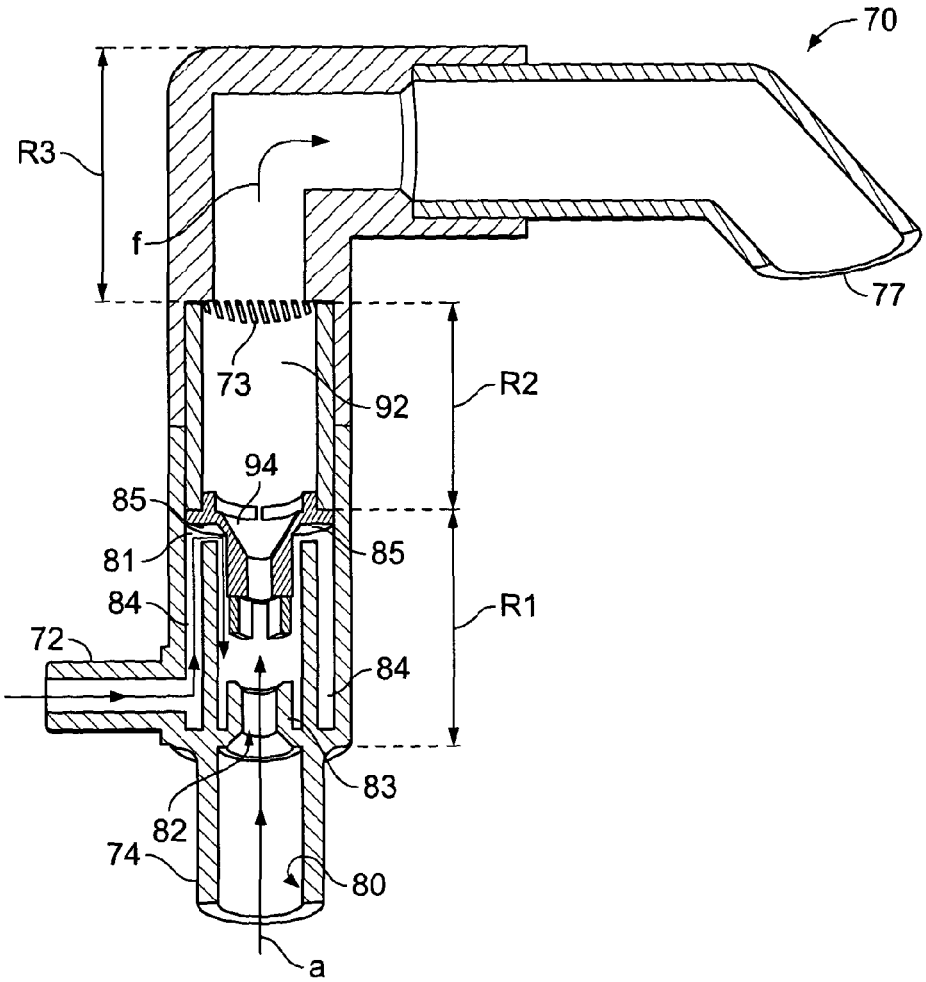
FIG. 4 depicts in cross-sectional view details of the interior of a preferred embodiment of dispensing nozzle.

FIG. 4 illustrates in a cross-sectional view a dispensing nozzle 70 having a liquid inlet port 72 and an air inlet port 74. The interior of the dispensing nozzle 70 includes a first mixing region "R1", within which the liquid composition is initially mixed with air, and downstream thereof a second mixing region "R2" immediately prior to a screen 73, and further downstream thereof is a foam exit region "R3" which extends to the dispensing outlet 77 from which the foamed liquid composition is delivered to a user. With reference to FIG. 4, the first mixing region RI is preferably generally cylindrical in cross section and includes a circular sidewall 80 extending into the dispensing nozzle 70 downstream of the air inlet port 74 which extends to the end of the first mixing region R1. Intermediate the length of the circular sidewall 80 there is present a constricted passage 82 of reduced diameter here defined by an inwardly extending circumferential skirt wall 83 which depends from the circular sidewall 80. At or below (downstream) of the circumferential skirt wall 83 an exterior liquid inlet chamber 84 is present and extends circumferentially about the circular sidewall 80 encasing it. The liquid inlet chamber 84 has an inlet at the liquid inlet port 72, and as an outlet includes a gap between the downstream end 81 of the circular sidewall 80 such that foamable liquid composition present within the liquid inlet chamber 84 flows in the direction of arrow "l" over the downstream end 81 of the circular sidewall 80 and through the gap 85 and into the region within R1 and downstream of the inwardly extending circumferential skirt wall 83 wherein it comes into contact with the air entering via air inlet port 74 where it initially mixes therewith. The mixed air and liquid exits R1 and enters R2 via an expanding orifice 94 which transits to an expansion chamber 92. As the mixed air and liquid exits R1 and enters R2 it passes through an orifice 94 which spread open as the mixed air and liquid transits downstream thereof, the internal pressure of the mixed air and liquid also drops relative to its pressure as it passes through the orifice 94, and this causes sudden volumetric expansion of the mixed air and liquid which immediately thereafter passes through a screen 73 extending across the flow path of the mixed air and liquid at the end of R2, which comminutes the mixed air and liquid and forms a foam therefrom, which further transits within the dispensing nozzle 70 and travels to the dispensing outlet 77 from which the foamed liquid composition is delivered to a user.

Advantageously the screen 73 includes a plurality of perforations passing therethrough of a relatively small size. Preferably the cross-sectional dimensions of the individual perforations, or alternately the radius of the individual perforations is preferably in the range of from about 10-2000 microns, preferably is in the range of about 50-1200 microns, and especially preferably are in the range of from about 100 microns to about 800 microns, and especially preferably is about 400 microns. It is of course to be understood that the selection of an optimal cross-sectional dimension or radius for these perforations may be influenced by other operating characteristics of the foaming pump mechanism, as well as the constituents used to form the foamable or foaming liquid composition being used with the foaming pump mechanism. It is also to be understood that the cross-sectional dimensions of the individual perforations, or alternately the radius of the individual perforations need not be of a single size, but may be of varying sizes or dimensions, which however fall within the preferred ranges noted herein.

Although the dispensing nozzle 70 may include a plurality of screens 73 in succession within its interior, surprisingly the present inventors have found that reliable operation of the foaming pumping mechanism may be achieved with only a single screen 73 present within the dispensing nozzle. While not wishing to be bound by the following hypothesis, it is believed that the combined forces of the flowing air and foaming or foamable liquid meeting within the dispensing nozzle 70 as depicted generates sufficient force and possible turbulent mixing so to provide for surprisingly good foaming even with the use of a single screen 73, contrary to expectations in the art.

Use of the preferred foaming pump mechanism as described provides a reliable mechanism for the delivery of a controlled dose of a foaming or foamable liquid composition which is particularly useful when incorporated into a device for delivery of such a product. It is considered that the foaming pump mechanism may be used with both manually operated dispensing devices wherein a user provides the motive force for the operation of the foaming pump mechanism, as well as in powered devices wherein a motor or engine is utilized to drive the foaming pump mechanism. Particularly advantageously the foaming pump mechanism is used as part of a "hands-free" type of dispenser which does not require direct physical contact between a user or consumer, but which device automatically dispenses a metered amount of the foaming or foamable liquid composition in response to an input signal which may be a non-contact input signal. Examples of non-contact input signal includes one or more of: sound, light, and proximity.

The bottle is a generally rigid plastics container containing, for example, liquid soap and the like. As can be understood from the figures, according to the preferred embodiment shown in the figures, the bottle 1 is generally elliptical in cross-section.

The foaming pump mechanism described herein, as well as dispensing devices which incorporate a foaming pump mechanism as taught herein may be used to deliver a wide variety of foamable or foaming liquid compositions in a reliable manner. It may also be used to dispense other liquid or semi-liquid products (ideally with a viscosity greater than water), for use in personal care, e.g., topically applied compositions such as hand cream, body lotion, moisturizer, face cream, acne treatments, shampoo, shower gel, foaming hand wash, shaving cream, washing-up liquid, toothpaste, a sanitizing composition agent such as alcohol gel or other topically applied sanitizing composition. The bottle may also be used to dispense other surface treatment compositions, (e.g., hard surface, soft surface) either directly to a locus to be treated, but preferentially onto a carrier material or substrate, such as a person's hand, a sponge, a brush, a wipe article, a disposable wipe article (napkin, tissue, paper towel, etc.) and the like. By way of non-limiting example such surface treatment compositions include those for the treatment of inanimate or non-porous hard surfaces, such as can be encountered in a kitchen or bath, dishware, tableware, pots, pans, textiles including garments, textiles, carpets, and the like. In the preferred embodiment shown, the bottle is specifically designed to be used in an inverted configuration on an automatic dispenser, as depicted in FIG. 1, but such is to be understood as a non-limiting illustration of one aspect of the invention.

The invention claimed is:

1. A foaming pump mechanism for dispensing a foam which comprises:

a liquid cylinder in fluid communication with a supply of a liquid composition and in fluid communication with a dispensing nozzle, the liquid cylinder further including a bore and a liquid cylinder piston moveable with the bore;

an air cylinder in fluid communication with the dispensing nozzle, the dispensing nozzle includes an a liquid inlet port, an air inlet port, further downstream thereof a single screen and a delivery outlet, wherein the volumetric ratios of the volumes of the liquid cylinder and the air cylinder between the base and peak of the stroke cycles is between 1:0.1-25, wherein a first mixing region of the dispensing nozzle is adapted to mix the liquid composition and air to produce a mixed air and liquid composition further wherein the first mixing region includes a circular sidewall and an inwardly extending circumferential skirt wall which depends from the circular sidewall, and wherein the single screen extends across a flow path of the mixed air and liquid composition in a second mixing region of the dispensing nozzle and is adapted to comminute the mixed air and liquid composition and forms a foam therefrom, such that the mixed air and liquid composition is present on a side of the single screen proximal to the second mixing region and the foam formed by the single screen is present on the opposing side of the single screen.

2. The foaming pump mechanism according to claim 1 wherein:

the volumetric ratios of the volumes of the liquid cylinder and the air cylinder between the base and peak of the stroke cycles is between 1:1-20.

3. The foaming pump mechanism according to claim 1 wherein:

the volumetric ratios of the volumes of the liquid cylinder and the air cylinder between the base and peak of the stroke cycles is between 1:5-15.

4. The foaming pump mechanism according to claim 1 wherein:

downstream of the bore of the liquid cylinder is present a liquid outlet valve which comprises: a valve bore, a biasing spring, a bore shoulder, a valve seat and a valve mounted on a valve shaft said valve shaft extending into the bore.

5. A dispenser for providing a foam to a user which comprises:

a reservoir which forms part of the dispenser, and a foaming pump mechanism according to claim 1.

6. The dispenser according to claim 5 wherein the reservoir is a refill unit insertable into a base of the dispenser.

7. The dispenser according to claim 5, wherein the dispenser initiates dispensing by a non-contact interaction with the user.

8. The dispenser according to claim 5 wherein the foaming pump mechanism is manually powered.

9. The dispenser according to claim 5 wherein the foaming pump mechanism is driven by a motor.

10. The foaming pump mechanism according to claim 3 further comprising a liquid outlet valve, located downstream of the bore of the liquid cylinder, wherein the liquid outlet valve comprises a valve bore, a biasing spring, a bore shoulder, a valve seat and a valve mounted on a valve shaft said valve shaft extending into the bore.

11. The foaming pump mechanism according to claim 10, wherein the dispensing nozzle includes only a single screen.

12. The dispenser according to claim 5, wherein the volumetric ratios of the volumes of the liquid cylinder and the air cylinder between the base and peak of the stroke cycles is between 1:5-15.

13. The dispenser according to claim 12, wherein the reservoir is a refill unit insertable into a base of the dispenser.

14. The dispenser according to claim 12, wherein the dispenser initiates dispensing by a non-contact interaction with the user.

15. The dispenser according to claim 12, wherein the foaming pump mechanism is manually powered.

16. The dispenser according to claim 12, wherein the foaming pump mechanism is driven by a motor.

* * * * *